US008603213B1

(12) United States Patent
Anderson et al.

(10) Patent No.: US 8,603,213 B1
(45) **Date of Patent: *Dec. 10, 2013**

(54) DISPERSOID REINFORCED ALLOY POWDER AND METHOD OF MAKING

(75) Inventors: Iver E. Anderson, Ames, IA (US); Joel Rieken, Ankeny, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 921 days.

This patent is subject to a terminal disclaimer.

(21) Appl. No.: 12/072,298

(22) Filed: Feb. 25, 2008

Related U.S. Application Data

(63) Continuation-in-part of application No. 11/429,918, filed on May 8, 2006, now Pat. No. 7,699,905.

(51) Int. Cl.
*C22C 33/02* (2006.01)
*C22C 38/28* (2006.01)

(52) U.S. Cl.
USPC ..... 75/255; 148/325; 148/331; 420/40; 428/403

(58) Field of Classification Search
USPC ..... 75/232–235
See application file for complete search history.

(56) References Cited

U.S. PATENT DOCUMENTS

| | | | | |
|---|---|---|---|---|
| 3,904,448 A | | 9/1975 | Takahashi et al. | 148/105 |
| 4,075,010 A | * | 2/1978 | Fischer | 75/235 |
| 4,336,242 A | | 6/1982 | Schmidberger et al. | 423/594 |
| 4,402,770 A | | 9/1983 | Koon | 420/435 |
| 4,533,408 A | | 8/1985 | Koon | 148/103 |
| 4,585,473 A | | 4/1986 | Narasimhan et al. | 148/101 |
| 4,597,938 A | | 7/1986 | Matsuura et al. | 148/105 |
| 4,619,845 A | | 10/1986 | Ayers et al. | 427/422 |
| 4,758,405 A | | 7/1988 | Couper | 75/338 |
| 4,801,340 A | | 1/1989 | Inoue et al. | 148/103 |
| 4,802,931 A | | 2/1989 | Croat | 148/302 |
| 4,867,809 A | | 9/1989 | Haverstick | 148/101 |
| 4,919,854 A | | 4/1990 | Walz | 75/338 |

(Continued)

FOREIGN PATENT DOCUMENTS

| | | |
|---|---|---|
| JP | 63-100108 | 5/1988 |
| JP | 63-109101 | 6/1988 |

OTHER PUBLICATIONS

"Simplified Powder Processing of Oxide Dispersion Stregnthened (OSD) Stainless Steel", MPIF-APMI International Conference on Powder Metallurgy and Particulate Materials 2006, San Diego, California, 2006.

*Primary Examiner* — George Wyszomierski

(57) ABSTRACT

A method of making dispersion-strengthened alloy particles involves melting an alloy having a corrosion and/or oxidation resistance-imparting alloying element, a dispersoid-forming element, and a matrix metal wherein the dispersoid-forming element exhibits a greater tendency to react with an introduced reactive species than does the alloying element and wherein one or more atomizing parameters is/are modified to controllably reduce the amount of the reactive species, such as oxygen, introduced into the atomized particles so as to reduce anneal times and improve reaction (conversion) to the desired strengthening dispersoids in the matrix. The atomized alloy particles are solidified as solidified alloy particles or as a solidified deposit of alloy particles. Bodies made from the dispersion strengthened alloy particles, deposit thereof, exhibit enhanced fatigue and creep resistance and reduced wear as well as enhanced corrosion and/or oxidation resistance at high temperatures by virtue of the presence of the corrosion and/or oxidation resistance imparting alloying element in solid solution in the particle alloy matrix.

15 Claims, 7 Drawing Sheets

(56) References Cited

U.S. PATENT DOCUMENTS

| | | | | | |
|---|---|---|---|---|---|
| 4,966,626 | A | * | 10/1990 | Fujiki et al. | 75/238 |
| 4,999,052 | A | | 3/1991 | Wilson | 75/338 |
| 5,024,695 | A | | 6/1991 | Ashdown et al. | 75/338 |
| 5,073,409 | A | | 12/1991 | Anderson et al. | 427/217 |
| 5,090,997 | A | | 2/1992 | Birkenstock et al. | 75/338 |
| 5,114,470 | A | | 5/1992 | Biancaniello et al. | 75/338 |
| 5,125,574 | A | | 6/1992 | Anderson et al. | 239/8 |
| 5,190,701 | A | | 3/1993 | Larsson | 75/338 |
| 5,196,049 | A | | 3/1993 | Combs et al. | 75/338 |
| 5,368,657 | A | | 11/1994 | Anderson et al. | 148/400 |
| 5,372,629 | A | | 12/1994 | Anderson et al. | 75/332 |
| 5,427,601 | A | * | 6/1995 | Harada et al. | 75/235 |
| 5,462,808 | A | * | 10/1995 | Asabe et al. | 428/551 |
| 5,635,255 | A | * | 6/1997 | Kwon et al. | 427/456 |
| 5,782,954 | A | * | 7/1998 | Luk | 75/252 |
| 5,908,486 | A | * | 6/1999 | Flinn et al. | 75/232 |
| 6,375,705 | B1 | * | 4/2002 | Judkins | 75/235 |
| 7,407,705 | B2 | * | 8/2008 | Sato | 428/402 |
| 8,197,574 | B1 | * | 6/2012 | Anderson et al. | 75/232 |

* cited by examiner

DISPERSOID REINFORCED ALLOY POWDER AND METHOD OF MAKING

RELATED APPLICATIONS

This application is a continuation-in-part application of Ser. No. 11/429,918 filed May 8, 2006, now U.S. Pat. No. 7,699,905, issued Apr. 20, 2010, the disclosure of which is incorporated herein by reference.

CONTRACTUAL ORIGIN OF THE INVENTION

The United States Government has rights in this invention pursuant to Contract No. DE-AC02-07CH11358 between the U.S. Department of Energy and Iowa State University.

FIELD OF THE INVENTION

The present invention relates to a method of making dispersoid strengthened, corrosion/oxidation resistant atomized alloy powder particles and to particles, deposits, and products formed therefrom.

BACKGROUND OF THE INVENTION

New types of IC (internal combustion) engines, both diesel and spark ignition, are being designed to burn alternative fuel mixtures. including pure hydrogen, and will present new, more challenging operating environment: (increased temperatures and corrosive gas content) for exhaust valves. Of the many components of IC engines, the engine exhaust valve is and will be one of the most challenging material systems. Each exhaust valve must resist exposure to hot (1400-1600 degrees F.) oxidizing combustion exhaust and must achieve and retain a challenging set of physical properties, including resistance to high cycle fatigue, extreme surface wear. and long-term creep deformation.

Current exhaust valves are multi-component material systems that consist of different Fe-based alloys that are joined and coated with several types of oxidation and wear resistant layers and their manufacture has been optimized for current vehicle operating environments.

Some advanced materials been proposed over the years as substitutions for existing materials to extend the lifetime or improve the performance of exhaust valves, including cast/wrought Ti alloys and oxide dispersion hardened Fe-base superalloys that are consolidated from mechanically alloyed powder (metal/oxide) blends.

Dispersoid strengthened metallic material typically comprises a metal or alloy matrix having dispersoids distributed uniformly throughout for strength enhancing purposes. The mechanical alloying (MA) process, particularly at full industrial scale, to make disperoid strengthened materials can add considerable cost to the process of making some very attractive alloys for high temperature service in harsh environments. In fact, the largest facilities in the US for making these types of alloys, in Huntington, W. Va., owned by Huntington Alloys, Inc., were recently shut down and put up for sale. Probably the most successful product of the mechanical alloying process is termed MA 956 by Inco Alloys International, Inc., and consists of Fe-20Cr-4.5Al-0.5Ti-0.5$Y_2O_3$-0.05C (in wt. %) that is an Fe-based alloy with dispersed $Y_2O_3$ particles for retained high temperature strength. In the manufacture of mill forms of MA 956 for example, the starting MA particulate is produced from a blend of Fe, Cr, and master alloy (Al—Ti, and Fe—C) powders, along with the addition of $Y_2O_3$ powder, which is milled for extended times (days) in a high energy milling unit, e.g., horizontal ball mill. Typically, the highly refined composite powders that result are consolidated by direct hot extrusion. Subsequent thermo-mechanical treatment, e.g., by hot rolling and high temperature heat treatment (1300 degrees C.) is needed to promote secondary recrystallization of the microstructure. This is needed to grow the grain size far coarser than the interparticle spacing of the dispersed $Y_2O_3$ particles (25 nm), which imparts some useful ductility to the final machined parts. Both the milling equipment and extensive milling time are very costly. well beyond normal ingot metallurgy processing steps for this class of alloys (either stainless steels or Ni-base superalloys) without dispersoids, although their high temperature strength retention can be superior.

Powder metallurgy methods represent one of the most cost effective materials processing approaches for mass production of high performance engine components, e.g., the universal displacement of cast steel by powder metallurgy (pressed/sintered/forged) processed steel for IC engine connecting rods.

Gas atomization is a commonly used technique for economically making fine metallic powder by melting the metallic material and then impinging a gas stream on the melt to atomize it into fine molten droplets that are rapidly solidified to form the powder. One particular gas atomization process is described in the Ayers and Anderson U.S. Pat. No. 4,619,845 wherein a molten stream is atomized by a supersonic carrier gas to yield fine metallic powder (e.g., powder sizes of 10 microns or less). Anderson U.S. Pat. Nos. 5,073,409 and 5,125,574 describe high pressure gas atomization of a melt in a manner to form a thin protective refractory nitride surface layer or film on the atomized powder particles. The '409 patent uses an atomizing gas, such as nitrogen, that selectively reacts with an alloy constituent to form the protective surface layer. The '574 patent uses an inert atomizing gas and a reactive gas contacted with the atomized droplets at a selected location downstream of the atomizing nozzle to form the protective layer. Various prior art techniques for forming protective layers on atomized powder by reacting a gaseous species with the melt, or a component of the melt, are discussed in these patents.

U.S. Pat. No. 5,368,657 discloses a powder making process called gas atomization reaction synthesis (GARS) wherein a superheated melt comprising a metallic material is formed and atomized with an atomizing gas to produce atomized particulates. The atomizing gas can comprise a carrier gas and a reactive gas or liquid that is reactive when dissolved in solid solution in the metallic material to form dispersoids therein. The temperature of the melt and the ratio of the carrier gas to the reactive gas are selected effective to provide a superequilibrium concentration of reactive species, such as nitrogen, in solid solution in at least a surface region of the atomized particulates. The atomized particulates can be heated to a temperature to react the dissolved species with the metallic material to form dispersoids therein. Alternately, the atomized particulates having a superequilibrium concentration of the dissolved species are formed into an article, and the article then is heated to a temperature to react the dissolved species with the metallic material to form dispersoids in the article.

Copending patent application Ser. No. 11/429,918 filed May 8, 2006, describes a method of making dispersoid-strengthened alloy particles in response to both present and anticipated needs for new material systems for IC engine exhaust valves and high temperature structural applications by development of cost effective processing methods for making dispersion strengthened alloy powder particles and products made therefrom having enhanced fatigue and creep resistance and reduced wear for automotive and heavy-duty vehicle applications as well as enhanced corrosion/oxidation resistance at high temperatures. The method involves providing an alloy comprising an environmental (e.g. corrosion or oxidation) resistance-imparting alloying element (e.g. Cr), a dispersoid-forming element (e.g. Y), and a matrix metal (e.g. Fe), wherein the dispersoid-forming element exhibits a greater tendency to react with a reactive species acquired from an atomizing gas than does the alloying element. The alloy is melted and atomized with the atomizing gas containing the reactive species so that the reactive species is reacted with the alloying element to form a surface compound and/or dissolved into solid solution to at least a depth below the surface of atomized particles. Thus secured, the reactive species is available for reaction with the dispersoid-forming element by subsequent particle heating and/or reacted with the dispersoid-forming element in-situ during atomization to form dispersoids in the atomized particles to at least a depth below the surface of the atomized particles. For an alloy comprising Fe-12.5% Cr-1% Y atomized using an atomizing gas mixture comprising argon-5 volume % oxygen, the atomized particles have been found to include about 20,000 ppm by weight oxygen as a chromium oxide surface compound and as Y—Cr—O dispersoids. Once consolidated, lengthy annealing times are required to convert a significant fraction of the chromium oxide to yttrium oxide dispersoids by an exchange reaction. Even with long anneal times, the chromium oxide may not be substantially converted, leaving unwanted chromium oxide in the particles which remain in a consolidated body made from the particles.

The present invention seeks to improve control of the amount of the reactive species, such as oxygen, introduced into the atomized particles so as to reduce anneal times and improve reaction (conversion) to the desired strengthening dispersoids in the matrix, resulting in an ideal microstructure, without significant remnants of the initial alloy surface compound.

SUMMARY OF THE INVENTION

The present invention provides a method of making dispersoid-strengthened alloy particles by providing an alloy comprising an environmental (e.g. corrosion or oxidation) resistance-imparting alloying element or elements, a dispersoid-forming element or elements, and a matrix metal, wherein the primary dispersoid-forming element exhibits a greater tendency (free energy driving force) to react with an introduced reactive species than does the primary alloying element and wherein one or more atomizing parameters is/are modified to controllably reduce the amount of the reactive species, such as oxygen, present in and/or as a surface compound on the atomized particles so as to reduce anneal times and improve reaction (conversion) to the desired strengthening dispersoids in the matrix.

The atomized alloy particles are solidified as alloy particles or as a deposit of alloy particles. Bodies formed from the dispersion strengthened alloy particles, or deposit thereof, exhibit enhanced fatigue and creep resistance and reduced wear as well as enhanced corrosion/oxidation resistance at high temperatures.

In an illustrative embodiment of the invention, the alloy is melted and atomized with the atomizing gas comprising the reactive species wherein the volume percentage of the reactive species in the atomizing gas is reduced to about 1 volume % or less of the atomizing gas to reduce the amount of the reactive species that is (a) dissolved in solid solution to at least a depth below the surface of atomized alloy particles for reaction with the dispersoid-forming element by subsequent particle heating, (b) reacted with the alloying element to form a compound for reaction with the dispersoid forming element by subsequent heating and/or (c) reacted with the dispersoid-forming element in-situ during atomization to form dispersoids in the atomized particles to at least a depth below the surface of the atomized particles.

In another illustrative embodiment of the invention, the alloy is melted and atomized with the atomizing gas which comprises a non-reactive gas, such as an inert gas, and the atomized particles are contacted with a secondary gas comprising the reactive species at a location downstream from the atomization zone to reduce the amount of the reactive species that is (a) dissolved in solid solution to at least a depth below the surface of atomized alloy particles for reaction with the dispersoid-forming element by subsequent particle heating, (b) reacted with the alloying element to form a compound for reaction with the dispersoid forming element by subsequent heating and/or (c) reacted with the dispersoid-forming element in-situ during atomization to form dispersoids in the atomized particles to at least a depth below the surface of the atomized particles. The reactive gas can comprise about 0.1 to about 25.0 volume % of the secondary gas, the balance being a non-reactive carrier gas, such as an inert gas.

The amount of the reactive species introduced into the atomized particles is controllably reduced so as to reduce anneal times and improve complete reaction (conversion) to the desired strengthening dispersoids in the matrix. In practice of illustrative embodiments of the invention, the amount of the reactive species in the atomized particles in solid solution and/or as a compound (including particle surface compounds and dispersoid compounds) is controllably reduced to approximately 10,000 to 400 ppm by weight. In a further illustrative embodiment of the invention, the atomized particles include the reactive species in solid solution and/or as a compound (including particle surface compounds and dispersoid compounds) in an amount from about 4000 to 400 ppm by weight, preferably from about 2000 ppm to about 800 ppm by weight to reduce anneal times and improve reaction (conversion) to the desired strengthening dispersoids in the matrix. These controlled reaction species concentrations apply to the oxygen reaction species, and can be expected to be similar for nitrogen, fluoride, carbon, or other reactive species that can be added from a gaseous state.

In practice of illustrative embodiments of the invention, the alloy composition can include an alloying element, such as Ti, Hf, V, Zr, Nb, and the like, that beneficially affects activity of the alloy melt for the reactive species, such as oxygen, so to controllably reduce the formation of an oxide of the environmental resistance-imparting alloying element, such as chromium oxides, as a passivating skin on the atomized particles. This helps to reduce anneal times and reduce the extent of reaction (conversion) to the desired strengthening dispersoids in the matrix. It should be noted that the alloying elements, including Cr, Ti, Hf, V, Zr, Nb, and the like, can all participate as substitutional additions into the most stable dispersoids.

The present invention envisions a post-atomization step of heating the solidified alloy particles, or deposit thereof, under an applied pressure to a sufficient temperature to react the dispersoid-forming element with the reactive species in solid solution and/or with a pre-existing compound formed between the alloying element and the reactive species so as to form dispersoids in the particle alloy matrix during this hot consolidation or during subsequent heat treatment. The solidified alloy particles, or deposit thereof, can be heated, consolidated, and reacted by vacuum hot pressing, hot isostatic pressing, hot extrusion, direct hot powder forging or other hot powder consolidation process, or by cold compaction and annealing or sintering at superambient temperature.

The present invention also provides in another embodiment atomized alloy particles, or deposit thereof, wherein the particles comprise an alloy matrix comprising the matrix metal and the environmental (corrosion or oxidation) resistance-imparting alloying element in solid solution in the matrix metal, and dispersoids formed in-situ in at least a surface region of the particle alloy matrix. The surface region preferably has a thickness greater than 1 micrometer.

In an illustrative embodiment of the invention for oxide dispersoid formation, the matrix metal is selected from the group consisting of Fe, Ni, Co, Cu, Ag, Au, and Sn while the alloying element is selected from the group consisting of Cr, Mo, W, V, Nb. Ta, Ti, Zr, Ni, Si, and B. For example, when the matrix metal is Fe and the alloying element is Cr, a Fe—Cr ferritic stainless steel type particle alloy matrix is provided. The alloy can include Ti, Hf, V, Zr, Nb, and the like, that beneficially affects activity of the melt for the reactive species, such as oxygen, so to controllably reduce the formation of an oxide of the environmental resistance-imparting alloying element, such as chromium oxides, as a skin on the atomized particles.

The dispersoid-forming element is selected from the group consisting of Sc, Y, and a Lanthanide series element having an atomic number in the range of 57 and 71. The reactive species is selected to react with the dispersoid-forming element to form oxide dispersoids in the particle alloy matrix, in this example, but could form nitride, carbide, boride, fluoride, and other refractory compound dispersoids in the particle matrix with other appropriately selected systems.

The present invention provides cost effective processing methods for making dispersion strengthened alloy particles and bodies and products made from the alloy particles having enhanced fatigue and creep resistance and reduced wear for automotive and heavy-duty vehicle applications as well as enhanced corrosion/oxidation resistance at high temperatures.

The aforementioned advantages of the present invention will become more readily apparent from the following detailed description taken in conjunction with the drawings.

DETAILED DESCRIPTION OF THE INVENTION

Figure 1:
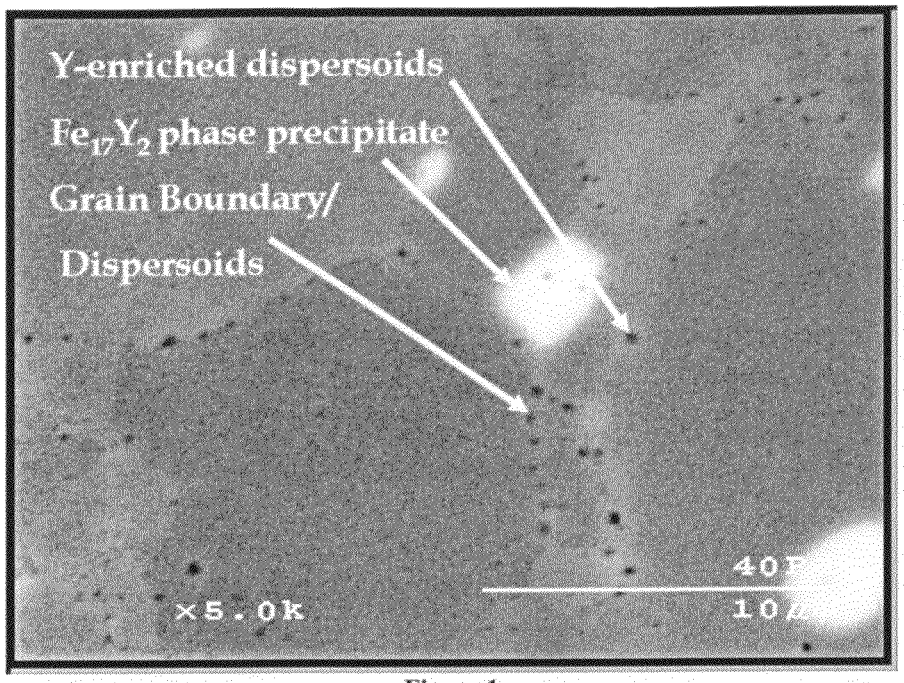
FIG. 1 is a scanning electron micrograph (SEM) of a consolidated particle microstructure of Example 1.

One embodiment of the present invention involves a linked series of alloy design changes and modified atomizing parameters that relate to the aforementioned GARS (U.S. Pat. No. 5,368,657) atomizing process that lead to the low-cost production of corrosion and/or oxidation resistant metallic alloy powder particles strengthened by a dispersion of highly refined refractory dispersoids that are extremely resistant to coarsening and strength degradation at elevated temperatures wherein one or more atomizing parameters is/are modified to controllably reduce the amount of the reactive species, such as oxygen, introduced into the atomized particles so as to reduce anneal times and improve reaction (conversion) to the desired strengthening dispersoids in the matrix. For example, in an illustrative embodiment of the invention, the alloy is melted and atomized with the atomizing gas comprising the reactive species wherein the volume percentage of the reactive species in the atomizing gas is reduced to about 1 volume % or less of the atomizing gas to reduce the amount of the reactive species that is (a) dissolved in solid solution to at least a depth below the surface of atomized alloy particles for reaction with the dispersoid-forming element by subsequent particle heating and/or (b) reacted with the alloying element to form a surface compound for reaction with the dispersoid forming element by subsequent heating and/or (c) reacted with the dispersoid-forming element in-situ during atomization to form dispersoids in the atomized particles to at least a depth below the surface of the atomized particles.

Another embodiment of the invention involves a linked series of alloy design and modified atomizing parameters of the aforementioned atomizing process of U.S. Pat. Nos. 5,372,629 and 5,589,199 that lead to the low-cost production of corrosion and/or oxidation resistant metallic alloy powder particles strengthened by a dispersion of highly refined refractory dispersoids that are extremely resistant to coarsening and strength degradation at elevated temperatures wherein the alloy is melted and atomized with the atomizing gas which comprises a non-reactive gas, such as an inert gas, and the atomized particles are contacted with a secondary gas comprising the reactive species at a location downstream from the atomizer to reduce the amount of the reactive species as described in the preceding paragraph. The reactive gas can comprise about 0.1 to about 25.0 volume % of the secondary gas, the balance being a non-reactive gas, such as an inert gas, since the secondary gas is located downstream from the atomizer.

In practice of the illustrative embodiments of the present invention, an alloy is provided comprising an environmental resistance-imparting (e.g. one or both of corrosion or oxidation resistance) alloying element (or elements), a dispersoid-forming element (or elements), and a matrix metal. The alloying element and the matrix metal are selected to form a desired particle alloy matrix, which is intrinsically corrosion and/or oxidation resistant by virtue of the alloying element being dissolved primarily in solid solution in the matrix metal.

The alloying element and the dispersoid-forming element are selected such that the alloying element imparts intrinsic corrosion and/or oxidation resistance to the particle alloy matrix and yet does not dominate or interfere with refractory compound (dispersoid) formation during the GARS process described in U.S. Pat. No. 5,368,657, or secondary gas contact described in U.S. Pat. Nos. 5,372,629 and 5,589,199 or, most importantly, during subsequent solid state reactions, including hot consolidating, sintering and high temperature heat treating. Although the alloying element can react to some extent with the reactive species, it does not dominate or interfere with formation of the refractory compounds (dispersoids). To this end, the dispersoid-forming element is selected to have a greater energetic tendency (e.g. ΔH value) to form dispersed refractory compounds (dispersoids) relative to that of the alloying element. Also to this same end, the alloys preferably include an insubstantial amount of Al, and even more preferably are free of Al, so as not to interfere with the dispersoid forming-reaction involving the dispersoid-forming element. Both corrosion/oxidation (environmental) resistance and dispersoid strengthening can be imparted to the alloy powder particles and deposits thereof. The dispersoids can be formed during atomization and/or after atomization in a subsequent particle heating process step conducted at elevated temperature. The GARS process is described in U.S. Pat. No. 5,368,657 of common assignee herewith, the teachings of which are incorporated herein by reference. The secondary gas contact process is described in U.S. Pat. Nos. 5,372,629 and 5,589,199 of common assignee herewith, the teachings of which are incorporated herein by reference.

The alloying element should not form an instantaneous surface film that substantially stops any additional reactions or dissolution of the reactive gas into the atomized alloy droplets during GARS processing or secondary gas contact processing. Thus, each resulting atomized alloy particle should have an alloy matrix that is intrinsically resistant to oxidation and/or corrosion and a thick (greater than at least 1 micrometer) surface region that contains refractory dispersoid particles or, at least an enhanced solubility of the reactive species that may react later during solid state high temperature processing to form additional refractory dispersoids.

For purposes of illustration of oxide dispersion formation and not limitation, the matrix metal can include, but is not limited to, Fe, Ni, Co, Cu, Ag, Au, or Sn, or combinations thereof, although the invention is not limited to any particular matrix metal. Preferred matrix metals include Fe, Ni, and Cu as a result of their common usage in structural components.

The environmental resistance-imparting alloying element can include, but is not limited to, Cr, Mo, W, V, Nb, Ta, Ti, Zr, Ni, Si, or B, or combinations thereof. As mentioned above, the alloying element is selected to dissolve in solid solution in the matrix metal to form a particle alloy matrix and to impart improved intrinsic corrosion and/or oxidation resistance to the particle alloy matrix. For purposes of illustration and not limitation, the matrix metal can comprise Fe and the alloying element can comprise Cr to form a Fe—Cr ferritic stainless steel type particle alloy matrix.

The dispersoid-forming element can include, but is not limited to, Sc, Y and a Lanthanide series element having an atomic number from 57 to 71 and reacts with the reactive species to form oxide dispersoids in the particle alloy matrix. Preferably, the dispersoid-forming element comprises Y in an amount of about 0.1 to about 0.5 weight % of the alloy composition, which is sufficient for reaction to form a significant volume fraction of dispersoids, but not appreciably greater that the solid solubility limit that can be retained during rapid solidification by gas atomization.

In practicing the illustrative embodiments of the invention, the alloy can include Ti, Hf, V, Zr, Nb, and the like, that beneficially affects activity of the melt for the reactive species, such as oxygen, so to controllably reduce the formation of an oxide of the environmental resistance-imparting alloying element, such as chromium oxides, as a skin on the atomized particles. Preferably, Ti is present to this end in an amount of about 0.50 to about 1.0 weight % of the alloy composition. When Ti is present in the alloy melt, the Ti preferentially forms titanium oxide (e.g. TiO) and reduces formation of the chromium oxide skin or film on the atomized particles.

For purposes of further illustration of oxide dispersion formation and not limitation, the invention can be practiced in connection with the following alloys:

Fe—Cr—Y ferritic stainless steel alloys, Ni—Cr—Y and Co—Cr—Y heat resistant alloys, or Cu—Ti—Y structural alloys that may substitute for Cu—Be to eliminate toxicity.

For purposes of illustration of nitride dispersion formation and not limitation, the matrix metal can include, but is not limited to, Fe, Ni, Co, Cu, Ag, Au, or Sn, or combinations thereof, although the invention is not limited to any particular matrix metal. Preferred matrix metals include Fe, Ni, and Cu as a result of their common usage for structural components.

The environmental resistance-imparting alloying element can include, but is not limited to, Mn, Cr, In, B, La, Nb, Ta, or V, or combinations thereof. As mentioned above, the alloying element is selected to dissolve in solid solution in the matrix metal to form a particle alloy matrix and to impart improved intrinsic corrosion and/or oxidation resistance to the particle alloy matrix. For purposes of illustration and not limitation, the matrix metal can comprise Fe and the alloying element can comprise Cr to form a Fe—Cr ferritic stainless steel type particle alloy matrix.

The dispersoid-forming element can include, but is not limited to, Ti, Ce, Sr, Zr, Mg, Hf, Be, or Si, or combinations thereof, that reacts with the reactive species to form nitride dispersoids in the particle alloy matrix.

For purposes of further illustration and not limitation, the invention can be practiced in connection with the following alloys:

Fe—Cr—Zr stainless steel alloys and Ni—V—Mg structural alloys.

GARS Processing

Figure 10:
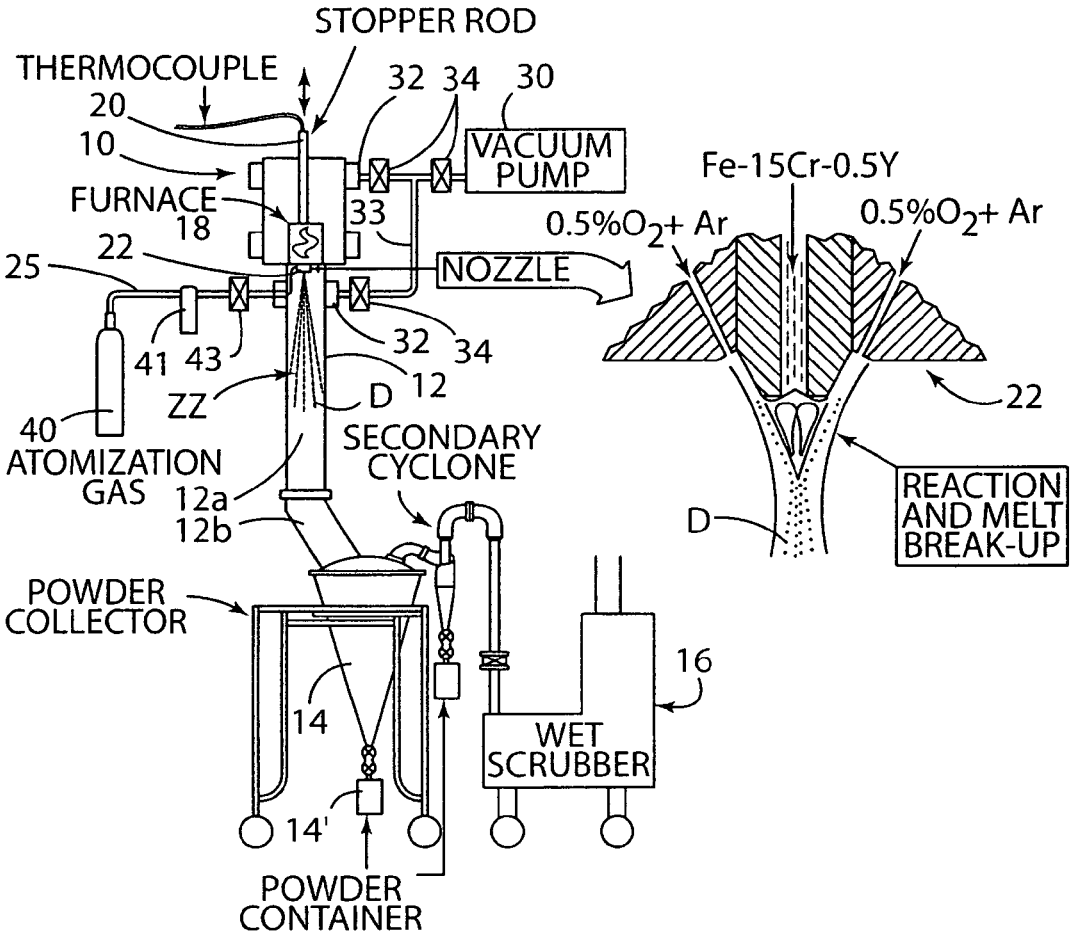
FIG. 10 is a schematic view of atomization apparatus for practicing an embodiment of the invention.

Referring to FIG. 10, a gas atomization apparatus is shown for practicing one embodiment of the present invention. The apparatus includes a melting chamber 10, a drop tube 12 beneath the melting chamber, a powder collection chamber 14 and an exhaust scrubbing system 16. The melting chamber 10 includes an induction melting furnace 18 and a vertically movable stopper rod 20 for controlling flow of melt from the furnace 18 to a melt atomizing nozzle 22 disposed between the furnace and the drop tube. The atomizing nozzle 22 preferably is of the supersonic gas type described in the Anderson U.S. Pat. No. 5,125,574, the teachings of which are incorporated herein by reference with respect to nozzle construction. Alternatively, the atomizing nozzle described in U.S. Pat. No. 6,142,382 or other suitable nozzles can be used. The atomizing nozzle 22 is supplied with an atomizing gas in a manner to be described through a conduit 25 and an open/close valve 43. As shown in FIG. 1, the atomizing nozzle 22 atomizes melt in the form of a spray of generally spherical, molten droplets D into the drop tube 12. An atomization spray zone ZZ is thus formed in the drop tube 12 beneath or downstream of the nozzle 22 in the drop tube 12.

Both the melting chamber 10 and the drop tube 12 are connected to an evacuation device (e.g., vacuum pump) 30 via suitable ports 32 and conduits 33. Prior to melting and atomization of the melt, the melting chamber 10 and the drop tube 12 are evacuated to a level of about $30\times10^{-3}$ torr to substantially remove ambient air. Then, the evacuation system is isolated from the chamber 10 and the drop tube 12 via the valves 34 shown and the chamber 10 and drop tube 12 are positively pressurized by an inert gas (e.g., argon to about 1.1 atmosphere) to prevent entry of ambient air thereafter.

The drop tube 12 includes a vertical drop tube section 12*a* and inclined section 12*b* that communicates with the powder collection chamber 14. The drop tube vertical section 12*a* has a generally circular cross-section having a diameter in the range of 1 to 3 feet, a diameter of 1 foot being used in the Examples set forth below.

The length of the vertical drop tube section 12*a* is typically about 9 to about 16 feet, a preferred length of 9 feet being used in the Examples set forth below, although other lengths can be used in practicing the invention.

Powder collection is accomplished by separation of the powder particles/gas exhaust stream in the tornado centrifugal dust separator/collection chamber 14 by retention of separated powder particles in the valved powder-receiving container 14' shown in FIG. 1.

A plurality of temperature sensing means (not shown), such as radiometers or laser doppler velocimetry devices, may be spaced axially apart along the length of the vertical drop section 12*a* to measure the temperature or velocity, respectively, of the atomized droplets D as they fall through the drop tube and cool in temperature.

Gas atomization apparatus of the type described above is disclosed in U.S. Pat. Nos. 5,125,574 and 5,368,657, the teachings of which are incorporated herein by reference.

A method embodiment of the present invention involves melting the above-described alloy comprising a corrosion and/or oxidation resistance-imparting alloying element, a dispersoid-forming element, and a matrix metal, wherein both the dispersoid-forming element and the alloying element exhibit a tendency to react with a reactive species acquired from the atomizing gas during atomization, but the dispersoid-forming element exhibits a greater tendency to react with the dissolved reactive species acquired from the atomizing gas, or with the alloying element/reactive species compounds, during post-atomization solid state reactions. In particular, a superheated melt comprising the alloy is formed in a crucible (not shown) preferably under an inert gas atmosphere in the melting furnace 18 and atomized using atomizing nozzle 22 to produce atomized powder particulates. The atomizing gas supplied to the nozzle 22 comprises a mixture including a carrier gas and a second reactive gas or liquid to provide the reactive atomic species that is reactive with both the alloying element and disperoid-forming element in a manner to form dispersoids in-situ in the particle alloy matrix and/or that becomes trapped as supersaturated reactive atomic species in the resulting solid matrix.

In accordance with this illustrative embodiment of the invention, the alloy is melted and atomized with the atomizing gas mixture that comprises the carrier gas and the reactive species wherein the volume percentage of the reactive gas in the atomizing gas mixture is controlled to be about 1 volume % or less, yet greater than 0, of the atomizing gas to reduce the amount of the reactive species that is (a) dissolved in solid solution to at least a depth below the surface of atomized alloy particles for reaction with the dispersoid-forming element by subsequent particle heating and/or (b) reacted with the alloying element to form a surface compound for reaction with the dispersoid forming element by subsequent heating and/or (c) reacted with the dispersoid-forming element in-situ during atomization to form dispersoids in the atomized particles to at least a depth below the surface of the atomized particles. Preferably, the reactive species comprises about 0.5 volume % or less of the atomizing gas mixture.

The carrier gas and reactive second gas are supplied either from a premixed high pressure gas mixture cylinder 40 or from conventional sources, such as high pressure cylinders or pressurized bottles, respectively, and mixed in the common conduit 25 that is communicated to the atomizing nozzle 22. The carrier gas typically comprises an inert gas, such as preferably ultra high purity argon, although the invention is not limited to use of inert gas as a carrier gas. Alternatively, an optional mixing chamber 41 can be connected to the conduit 25 where a vapor or mist of liquid droplets comprising the reactive species can be added from a vapor or mist source (not shown) and mixed into the atomizing gas before it enters the atomizing nozzle 22.

The reactive gas is selected to provide the reactive species that is (a) dissolved in solid solution at a superequilibrium (supersaturated) concentration to at least a depth below the surface of atomized particles for reaction with the dispersoid-forming element by subsequent particle heating and/or (b) reacted with the alloying element to form a surface compound for reaction with the dispersoid forming element by subsequent heating and/or (c) reacted with the alloying element and the dispersoid-forming element in-situ during atomization to form dispersoids in the atomized particles to at least a depth below the surface of said atomized particles. The surface region preferably has a thickness or depth greater than 1 micrometer and preferably through the entire diameter of the particle.

For example, the second reactive gas can comprise ultra high purity oxygen or nitrogen when it is desired to form alloy particles having atomic oxygen or nitrogen dissolved in solid solution and/or when it is desirable to form oxide or nitride surface compounds with the alloying element and/or when it is desirable to form oxide or nitride dispersoids with the dispersoid-forming element in-situ therein during atomization. The second, reactive gas is not limited to nitrogen or oxygen and can comprise other ultra high purity gases to form boride, carbide, silicide and fluoride dispersoids in the matrix metal. For example, ultra high purity borane gas can be used when it is desired to form powder particles having atomic boron dissolved in solid solution therein for purposes of forming boride dispersoids in-situ therein by a subsequent particle heating and/or to form boride dispersoids in-situ during atomization. Carbide disperoids can be formed using an aromatic hydrocarbon as the reactive species of the atomizing gas. Other appropriate carrier gas/reactive gas mixtures can used as the atomizing gas to make alloy particles having atomic oxygen, carbon, silicon, germanium, etc., dissolved in solid solution therein or formed as surface compounds for subsequent conversion to dispersoids upon heat treatment and/or to form oxide, carbide, silicide, germanides, etc. dispersoids in-situ therein during atomization.

A high superequilibrium (supersaturated) concentration of the reactive species including, but not limited to, oxygen and nitrogen can be dissolved in solid solution in the atomized powder particles by proper selection of the temperature of the melt and the ratio of the carrier gas to the second, reactive gas or liquid. In particular, a high concentration of dissolved reactive atomic species of the second, reactive gas in the atomized powder particles beyond the predicted equilibrium concentration can be achieved by atomization of the melt (1) at a melt superheat temperature that is not high enough to cause vaporization of the atomized droplets in the spray zone ZZ and yet is high enough to promote high fluidity and atomic mobility within the liquid atomized droplets and (2) at a ratio of carrier gas-to-second gas that is high enough (low enough partial pressure of the second gas) to substantially prevent reaction of the second gas with the atomized melt in the atomization spray zone ZZ in a manner to form compound(s) therewith and that is low enough (high enough partial pressure of the second gas) to achieve substantial dissolution of the atomic specie of the second gas in at least the surface region of the atomized melt particles in the atomization spray zone ZZ.

Typically, a superequilibrium (supersaturated) concentration of the reactive species dissolved in solid solution, formation of partial coverage of a surface compound with the alloying element, and formation of refractory compound dispersoids in the atomized particles are achieved during atomization.

The cooling rate of the melt droplets in the atomization spray zone ZZ is sufficiently rapid to trap or quench the dissolved atomic reactive species of the second, reactive gas in solid solution to at least a substantial depth below the outer surface of the atomized particles (e.g. a region at least about 1.0 micron in depth from the outer particle surface) as they rapidly solidify in the atomization spray zone ZZ. The particles solidify wholly (i.e. through the entire cross-section) in the atomization spray zone ZZ to provide a generally spherical particle shape and trap the dissolved species in the matrix metal.

The atomization parameters (e.g. gas stoichiometry, melt superheat, melt composition, atomization gas pressure, chemistry of gas species) can be adjusted to achieve the aforementioned high supersaturation of the reactive species and/or dispersoid formation throughout the particle cross-section, rather than in a surface region. For example, at a given level of reaction kinetics, an enhanced atomization energy level can produce smaller atomized droplets which, on average, would experience penetration of the dissolved atomic specie throughout the entire particle diameter, as the supersaturated surface region or zone approaches overlap at the droplet center. Atomization parameter(s) can be adjusted to this end. Supersaturation of the reactive species can be achieved across the substantially whole particle rather than a surface region, if the droplets involved in the reaction are sufficiently small.

Secondary Gas Contact Processing

Figure 11:
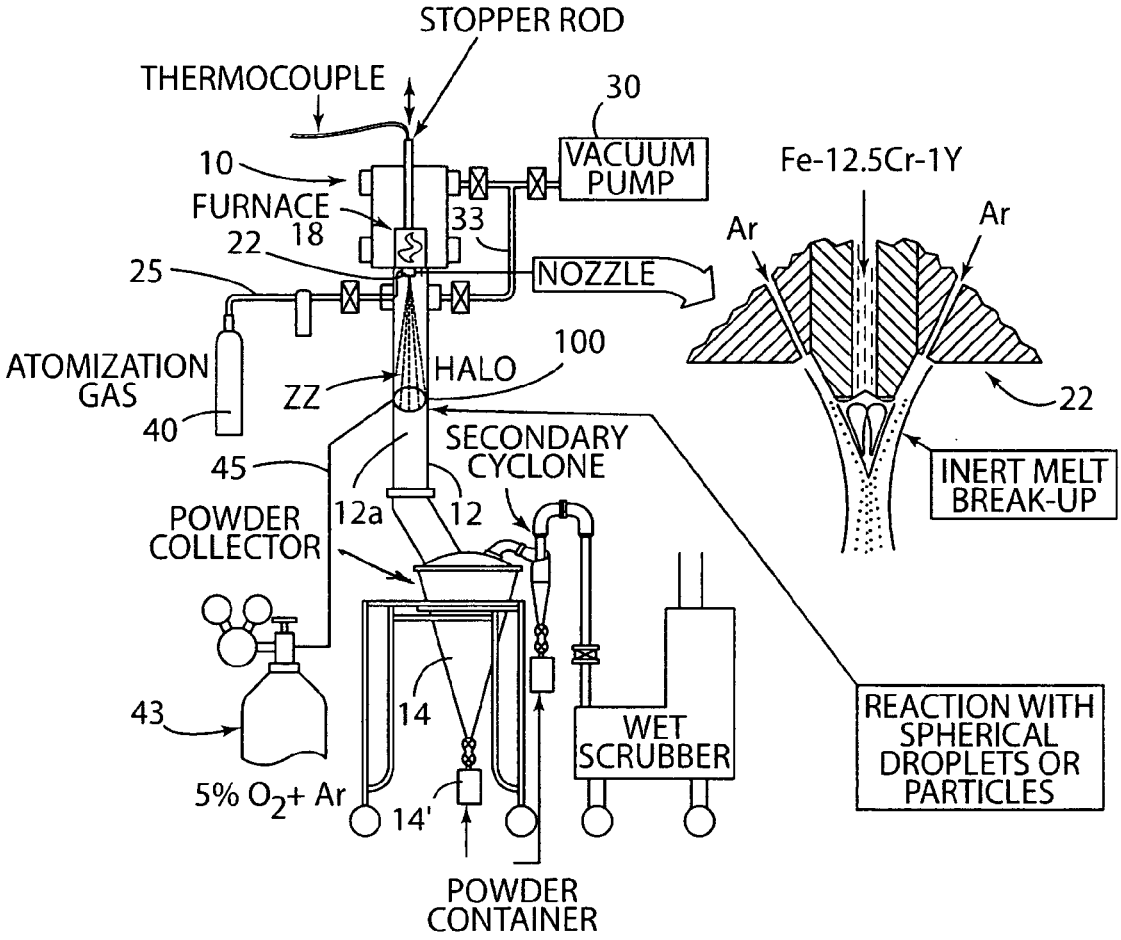
FIG. 11 is a schematic view of atomization apparatus for practicing another embodiment of the invention using a reactive gas halo downstream of an atomizing nozzle.

Referring to FIG. 11, a gas atomization apparatus is shown for practicing another illustrative embodiment of the present invention as described in U.S. Pat. Nos. 5,372,629 and 5,589,199. The apparatus includes the same mechanical components which are described above for the GARS processing and which are given the same reference numerals as a result in FIG. 11, with the following exceptions:

An annular halo tube 100 is placed in the drop tube 12 downstream of the atomizing nozzle 22 (e.g. 20 centimeters downstream) to discharge a secondary gas comprising a carrier gas and a reactive second gas. The secondary gas is supplied from cylinder 43 via conduit 45 connected to halo tube 100. The carrier gas typically comprises an inert gas, such as preferably ultra high purity argon, although the invention is not limited to use of inert gas as a carrier gas. In accordance with this illustrative embodiment of the invention, the alloy is melted and atomized with the atomizing gas which comprises a non-reactive gas, such as an inert gas, and the atomized particles are contacted with a secondary gas from the halo tube 100 that comprises the reactive species at a location downstream from the atomizer to react with the hot atomized particles, thereby reducing the amount of the reactive species by reducing the amount of reaction with the atomized particles, which may or may not have a partially solidified shell formed thereon by the time they reach the halo location. The reactive gas can comprise about 0.1 to about 25.0 volume % of the secondary gas, the balance being a non-reactive gas, such as an inert gas, since the secondary gas is located downstream from the atomizer.

The reactive gas is selected to provide the reactive species that is (a) dissolved in solid solution at a superequilibrium (supersaturated) concentration to at least a depth below the surface of atomized particles for reaction with the dispersoid-forming element by subsequent particle heating and/or (b) reacted with the alloying element to form a surface compound for reaction with the dispersoid forming element by subsequent heating and/or (c) reacted with the alloying element and the dispersoid-forming element in-situ during atomization to form dispersoids in the atomized particles to at least a depth below the surface of said atomized particles. The surface region preferably has a thickness or depth greater than 1 micrometer and preferably through the entire diameter of the particle.

The second reactive gas can comprise ultra high purity oxygen or nitrogen when it is desired to form alloy particles having atomic oxygen or nitrogen when it is desirable to form oxide or nitride dispersoids in-situ therein during atomization. The second, reactive gas is not limited to nitrogen or oxygen and can comprise other ultra high purity gases to form boride, carbide, silicide and fluoride dispersoids in the matrix metal. For example, ultra high purity borane gas can be used when it is desired to form powder particles having atomic boron dissolved in solid solution therein for purposes of forming boride dispersoids in-situ therein by a subsequent particle heating and/or to form boride dispersoids in-situ during atomization. Carbide disperoids can be formed using an aromatic hydrocarbon as the reactive species of the atomizing gas. Other appropriate carrier gas/reactive gas mixtures can used as the atomizing gas to make alloy particles having atomic oxygen, carbon, silicon, germanium, etc., dissolved in solid solution therein for subsequent heat treatment and/or to form oxide, carbide, silicide, germanides, etc. dispersoids in-situ therein during atomization.

The reactive species of the secondary gas reacts to form dispersoids and/or a partial or complete surface film of a compound (e.g. chromium oxide or nitride) on the hot atomized particles and/or superequilibrium (supersaturated) concentration of the reactive species dissolved in solid solution in the atomized powder particles by proper selection of the temperature of the melt and the ratio of the carrier gas to the second, reactive gas in the secondary gas. Typically, a superequilibrium (supersaturated) concentration of the reactive species dissolved in solid solution, formation of partial or complete coverage of a surface compound with the alloying element, and formation of refractory compound dispersoids in the atomized particles are achieved during atomization.

The cooling rate of the melt droplets in the atomizer downtube (spray chamber) is sufficiently rapid to trap or quench the dissolved atomic reactive species of the second, reactive gas in solid solution to a minimal depth (e.g., less than 1.0 micron) and/or as a surface compound with the alloying element on the outer surface of the atomized particles as they rapidly solidify in the atomizer down tube. The particles solidify wholly (i.e. through the entire cross-section) in the atomizer downtube to provide a generally spherical particle shape and trap the dissolved species in the matrix metal.

Post-Atomization Processing

The present invention envisions post-atomization processing of the atomized alloy particle to form a body or product from the atomized alloy particles. In one embodiment, the next step in the processing of the atomized alloy particles comprises high temperature near-net shape consolidation to essentially full density by one of several methods, including vacuum hot pressing (VHP), hot isostatic pressing (HIP), hot extrusion, or direct (hot) powder forging. It is during the thermal excursion of the VHP, HIP, extrusion, or forging process that any dissolved, but unreacted, gas may diffuse locally and form additional refractory compounds as dispersoids within the particle matrix microstructure.

The selected method for consolidation of the alloy particles will depend on the desired net shape and size of the final product and the need to minimize the number of processing steps to produce it. For example, if the desired product is a bar or tube, hot extrusion may be the most desirable powder consolidation step. Post-consolidation annealing at high temperatures may also be desirable to promote further oxygen exchange reactions and formation of the more stable dispersoids, at the expense of the less stable oxide phase. It should also be noted that a final forging step or additional extrusion/swaging/drawing steps may also be desired to produce enhanced interparticle bonding or increased microstructural refinement or texturing. Conventional machining can be used to produce each final net shape part.

The present invention also envisions in still another embodiment post-atomization processing that involves selecting only ultrafine powder particles (typically diameter <25 μm) from the atomization batch yield. These ultra fine powder particles are mixed with a processing binder and used in a powder injection molding method to form an oversize net shape body. The processing binder (typically a low melting, volatile polymer) is removed, and then the body is sintered with uniform shrinkage to full density and final net shape. It is during the thermal excursion of the high temperature sintering process that any dissolved, but unreacted, atomizing gas specie may diffuse locally and form additional refractory compounds (dispersoids) within the alloy matrix microstructure.

In a still further embodiment, the present invention envisions the spray deposition of the atomized alloy particles on a mandrel or other support to deposit a near-full density preform. The spray deposition process involves interrupting the atomization spray after the GARS reaction has occurred and before the atomized particles have solidified completely. This interruption is achieved by appropriately positioning a mandrel support at a location in the path of the atomization spray so that the partially or fully molten atomized particles impinge on the mandrel support and deposit and solidify thereon. The atomized particles impact the mandrel support as particulate "splats" which build-up over time to form a deposit of solidified particle splats. The well known "Osprey" process invented by Singer and co-workers describes such a spray deposition method.

By using this spray deposition process, the handling of loose powder particles can be avoided and improved interparticle bonding and microstructural refinement can be achieved without secondary thermal-mechanical processing. Since the spray deposited pre-forms (typically bodies such as tubular members or cylindrical mounds) are not of full density, a hot forging or hot extrusion step is usually needed to produce a fully consolidated, near-net shape part that is ready for conventional machining to produce each final net shape part. It is during the thermal excursion of the forging or extrusion process that any dissolved, but unreacted, atomizing gas reactive species may diffuse locally and react with the dispersoid-forming element to form additional refractory phases within the microstructure of the particle alloy matrix.

In the above post-atomization processing embodiments, due to the purposeful presence of the competing (but unequal) reactive alloying element and the dispersoid-forming element; e.g., Cr and Y, any Cr oxide phase formed on the prior particle boundaries during atomization can serve as an additional source of oxygen for reaction with the more oxidizable component, Y, to form more finely dispersed $Y_2O_3$ particles adjacent to prior particle boundaries and throughout the matrix microstructure. Thus, not only are the desirable (most stable) dispersoids formed in greater numbers, any semi-continuous Cr oxide films on the prior particle surfaces are at least partially dissolved and allow improved oxidation/corrosion resistance, interparticle bonding, and microstructural integrity. In the most highly preferred embodiment, the content of the dispersoid-forming element, e.g., Y, is perfectly balanced with the reactive gas, e.g., oxygen, reservoir level both dissolved and at the alloy surface compound, e.g., $Cr_2O_3$ so that the completed exchange reaction can occur with no residual alloy oxide content on the PPB.

Although the corrosion/oxidation resistance-imparting alloying element can react to some extent with the reactive species acquired from the atomizing gas, it does not dominate refractory phase formation by the dispersoid-forming element during the GARS atomizing process or during subsequent solid state reactions, including sintering and high temperature heat treating. In other words, it is desirable that the oxidation and/or corrosion resistant alloying element should not form an instantaneous surface film that stops any additional reactions or dissolution of the reactive gas species into the atomized alloy droplets during GARS processing. Thus, each resulting atomized alloy particle should have an alloy matrix that is intrinsically resistant to oxidation and/or corrosion and a thick (greater than at least 1 micrometer) surface region that contains refractory phase dispersoids or, at least an enhanced solubility of the reactive gas species that may react later during solid state high temperature processing to form additional refractory phases.

The Examples below set forth conditions for processing of an iron alloy having Cr as a corrosion/oxidation resistance-imparting solid solution alloying element and Y as a dispersoid-forming element. The Cr alloying element was present in an amount effective to impart intrinsic corrosion and oxidation resistance to the particle alloy matrix, which corresponds to a Type 410 ferritic stainless steel at least with respect to Fe and Cr concentrations. The Y is provided in an amount to react in the surface region and elsewhere in the particle matrix with dissolved O (reactive species) and with any oxide compounds of Cr to form refractory dispersoids in the particle alloy matrix during atomization and/or later during solid state high temperature processing.

Example 1

GA-1-96

Example 1 sets forth conditions for processing of an iron alloy having Cr as a corrosion/oxidation resistance-imparting solid solution alloying element and Y as a dispersoid-forming element shown in FIG. 11. The nominal composition of the alloy, in weight %, was 12.5% Cr, 1.0% Y, and balance Fe. The Cr alloying element was present in an amount effective to impart intrinsic corrosion and oxidation resistance to the particle alloy matrix, which corresponds to the Cr-rich side of the specifications of a Type 410 ferritic stainless steel at least with respect to Fe and Cr concentrations. The Y is provided in an amount to enhance reaction in the surface region and elsewhere in the particle matrix with dissolved O (reactive species) and with any oxide compounds of Cr to form refractory dispersoids in the particle alloy matrix during atomization and/or later during solid state high temperature processing.

The melting furnace was charged with 4000 g, comprising 3447.4 g of Fe (Tophet, high purity grade), 500 g of Cr (Tosoh, high purity grade), and 52.6 g of an Fe—Y chill cast button (Fe-76Y, wt. %) using Y of 99.5% purity. The charge was melted in the induction melting furnace in a high purity, coarse grain zirconia (MgO-stabilized) crucible, obtained from Zircoa. A pour tube made of plasma arc spray deposited zirconia ($Y_2O_3$ stabilized) and a stopper rod made of hard fired alumina, obtained from Coors Ceramics, were used. The charge was melted in the induction furnace after the melting chamber and the drop tube (spray chamber) were evacuated to $3.76\times10^{-5}$ atmosphere and then pressurized with argon to 1.1 atmosphere. The melt was heated to a temperature of 1700 C (providing about 160 C superheat above the alloy liquidus temperature). After a hold period of 2 minutes to stabilize the molten alloy temperature, the melt was fed via the pour tube to the atomizing nozzle by gravity flow upon raising of the alumina stopper rod. The atomizing nozzle was of the type described in U.S. Pat. No. 5,125,574, the teachings of which are incorporated herein by reference with respect to nozzle construction.

The atomizing gas was ultrahigh purity argon (99.95%). The pure argon atomization gas was supplied at 6.9 MPa (1000 psig), measured at the respective gas supply regulator, to the atomizing nozzle. The flow rate of the atomizing gas to the atomizing nozzle was about 10.3 $m^3$/min. The reactive gas was comprised of a (factory-supplied) mixture of argon and oxygen in a ratio of 95:5 (i.e., 95 vol. % Ar and 5 vol. % $O_2$) and was supplied through a 20.3 cm diameter copper far-field halo tube located 20 cm below the atomizing nozzle (FIG. 11 and U.S. Pat. Nos. 5,372,629 and 5,589,199). The reactive gas was supplied at 0.69 MPa (100 psig), measured at the respective gas supply regulator, to the far-field halo supply line.

This atomization experiment was performed to test the ability to manipulate the in situ surface oxidation reaction occurring between the atomized Fe—Cr—Y powder particles and the reactive gas. By moving the reaction zone further downstream from the atomization nozzle the kinetics of the surface oxide reaction become sluggish and a thin chromium oxide shell (less than 30 nm) forms around each powder particle. The entire alloy charge was poured and atomized into powder with a run time of 201.1 seconds.

The atomized powder particle yield was screened to select a size class from 20 to 53 microns, which represented about 58.05% of the collected powder, and 500 g of this powder was subjected to consolidation experiments. Also, the powder yield was screened to select a size class below 20 microns, which represented about 33.63% of the collected powder. The remainder of the powder that was collected during the run was retained for several types of characterization experiments to determine the effect of the innovative processing. Oxygen analysis of the powder showed an average (of 3 measurements) oxygen content of 804 ppmw (ppm by weight) and was analyzed using a LECO inert gas fusion apparatus, capable of nitrogen and oxygen determination.

SEM examination has shown that the microstructure, consolidated by hot isostatic pressing (HIP) at 1300° C. and 303 MPa for 4 hours in a 316L stainless steel can, has fully dissolved the Cr oxide phase on the prior particle boundaries. Additional Y-enriched oxide dispersoid particles and Y-containing intermetallic phase ($Fe_{17}Y_2$) regions were observed and verified by point-mode energy dispersive spectroscopy (EDS), within the typical prior particle microstructure shown in FIG. 1. The microstructure shown in FIG. 1 represents the phase distribution that can develop when the oxygen supply reservoir (Cr oxide phase) is deficient. When the ratio of yttrium-to-oxygen is non-ideal the un-reacted yttrium is rejected from the alpha iron lattice and precipitates into $Fe_{17}Y_2$ phase regions throughout the consolidated microstructure. The microstructure in FIG. 1 shows that several grains (of different gray contrast) are present typically within each prior particle boundary. Also, SEM observations like FIG. 1, along with EDS analysis (not shown) of the composition, established that the Y-enriched dispersoids are less than 0.5 μm and are present along grain boundaries and within the interior of the grains of the HIP microstructure, as shown in the micrograph of FIG. 1. TEM analysis with EDS and electron diffraction techniques would provide more precise composition and structure analysis of the Y-enriched dispersoids because their small size (relative to the electron beam size), but SEM analysis is sufficient for identification relative to this mechanism.

Example 2

GA-1-104

Example 2 sets forth conditions for processing of an iron alloy having Cr as a corrosion/oxidation resistance-imparting solid solution alloying element and Y as a dispersoid-forming element shown in FIG. 11. The nominal composition of the alloy, in weight %, was 12.5% Cr, 1.0% Y, and balance Fe. The Cr alloying element was present in an amount effective to impart intrinsic corrosion and oxidation resistance to the particle alloy matrix, which corresponds to the Cr-rich side of the specifications of a Type 410 ferritic stainless steel at least with respect to Fe and Cr concentrations. The Y is provided in an amount to enhance reaction in the surface region and elsewhere in the particle matrix with dissolved O (reactive species) and with any oxide compounds of Cr to form refractory dispersoids in the particle alloy matrix during atomization and/or later during solid state high temperature processing.

The melting furnace was charged with 4000 g, comprising 3447.4 g of Fe (Tophet, high purity grade), 500 g of Cr (Tosoh, high purity grade), and 52.6 g of an Fe—Y chill cast button (Fe-76Y, wt. %) using Y of 99.5% purity. The charge was melted in the induction melting furnace in a high purity, coarse grain zirconia (MgO-stabilized) crucible, obtained from Zircoa. A pour tube made of plasma arc spray deposited zirconia ($Y_2O_3$ stabilized) and a stopper rod made of hard fired alumina, obtained from Coors Ceramics, were used. The charge was melted in the induction furnace after the melting chamber and the drop tube (spray chamber) were evacuated to $6.1\times10^{-5}$ atmosphere and then pressurized with argon to 1.1 atmosphere. The melt was heated to a temperature of 1700 C (providing about 160 C superheat above the alloy liquidus temperature). After a hold period of 2 minutes to stabilize the molten alloy temperature, the melt was fed via the pour tube to the atomizing nozzle by gravity flow upon raising of the alumina stopper rod. The atomizing nozzle was of the type described in U.S. Pat. No. 5,125,574, the teachings of which are incorporated herein by reference with respect to nozzle construction and the downstream reactive gas treatment was of the type described in U.S. Pat. Nos. 5,372,629 and 5,589,199.

The atomizing gas was ultrahigh purity argon (99.95%). The pure argon atomization gas was supplied at 6.9 MPa (1000 psig), measured at the respective gas supply regulator, to the atomizing nozzle. The flow rate of the atomizing gas to the atomizing nozzle was about 10.3 $m^3$/min. The reactive gas was comprised of a (factory-supplied) mixture of argon and oxygen in a ratio of 95:5 (i.e., 95 vol. % Ar and 5 vol. % $O_2$) and was supplied through a 6 cm diameter near-field halo tube located 7.6 cm below the atomizing nozzle (FIG. 11). The reactive gas was supplied at 2.76 MPa (400 psig), measured at the respective gas supply regulator, to the near-field halo supply line.

This atomization experiment was performed to test the ability to manipulate the in situ surface oxidation reaction occurring between the atomized Fe—Cr—Y powder particles and the reactive gas. By moving the reaction zone directly below the atomization nozzle the kinetics of the surface oxide reaction should be enhanced with the goal of reaching an ideal yttrium-to-oxygen ratio within the final consolidated microstructure. The majority of the alloy charge was poured and atomized into powder with a run time of 52.0 seconds.

The atomized powder particle yield was screened to select a size class from 20 to 53 microns, which represented about % of the collected powder, and 100 g of this powder was subjected to testing and characterization. Also, the powder yield was screened to select a size class below 20 microns, which represented about 35% of the collected powder, and 100 g of this powder was provided for additional testing and characterization. The remainder of the powder that was collected during the run was retained for future testing. Oxygen analysis of the powder showed the average (of 3 measurements) oxygen content to be 477 ppmw and was analyzed using a LECO inert gas fusion apparatus, capable of nitrogen and oxygen determination.

Post atomization analysis revealed that, due to a valve malfunction, no reactive Ar-5.0$O_2$ vol. % gas was released, and, therefore, no enhanced reaction could have taken place between the as-atomized particles and the reactive gas. This resulted in an average oxygen content that was significantly lower than the far-field halo reaction experiment. Because of the valve malfunction and the resulting low oxygen content, the powder particles from this experiment were not consolidated for further microstructure analysis.

Example 3

GA-1-112

Example 3 sets forth conditions for GARS processing of an iron alloy having Cr as a corrosion/oxidation resistance-imparting solid solution alloying element and Y as a dispersoid-forming element shown in FIG. 10. The nominal composition of the alloy, in weight %, was 15.0% Cr, 0.5% Y, and balance Fe. The Cr alloying element was present in an amount effective to impart intrinsic corrosion and oxidation resistance to the particle alloy matrix, which corresponds to the Cr-rich side of the specifications of a Type 405 ferritic stainless steel at least with respect to Fe and Cr concentrations. The Y is provided in an amount to enhance reaction in the surface region and elsewhere in the particle matrix with dissolved O (reactive species) and with any oxide compounds of Cr to form refractory dispersoids in the particle alloy matrix during atomization and/or later during solid state high temperature processing. However, this time a reduced Y content was used to reduce or eliminate the potential to form (undesirable) Fe—Y intermetallic phases, e.g., $Fe_{17}Y_2$, in the as-solidified or consolidated microstructure, i.e., to avoid supersaturation of Y in the liquid or solid alloy.

The melting furnace was charged with 4000 g, comprising 3474.7 g of Fe (Tophet, high purity grade), 600 g of Cr (Tosoh, high purity grade), and 26.32 g of an Fe—Y chill cast button (Fe-76Y, wt. %) using Y of 99.5% purity. The charge was melted in the induction melting furnace in a high purity, coarse grain zirconia (MgO-stabilized) crucible, obtained from Zircoa. A pour tube made of plasma arc spray deposited zirconia ($Y_2O_3$ stabilized) and a stopper rod made of hard fired alumina, obtained from Coors Ceramics, were used. The charge was melted in the induction furnace after the melting chamber and the drop tube were evacuated to $6.5\times10^{-5}$ atmosphere and then pressurized with argon to 1.1 atmospheres. The melt was heated to a temperature of 1700 C (providing about 160 C superheat above the alloy liquidus temperature). After a hold period of 2 minutes to stabilize the molten alloy temperature, the melt was fed via the pour tube to the atomizing nozzle by gravity flow upon raising the alumina stopper rod. The atomizing nozzle was of the type described in U.S. Pat. No. 5,125,574, the teachings of which are incorporated herein by reference with respect to nozzle construction.

The atomizing gas comprised a mixture of argon and oxygen in a ratio of 99.5:0.5 (i.e., 99.5 vol. % Ar and 0.5 vol. % $O_2$) shown in FIG. 10 and was supplied as a factory made mixture. The argon/oxygen gas mixture was supplied at 6.9 MPa (1000 psig), measured at the respective gas supply regulator, to the atomizing nozzle. The flow rate of the atomizing gas mixture to the atomizing nozzle was about 10.3 $m^3$/min.

This atomization experiment was performed to test the ability to manipulate further the in situ surface oxidation reaction occurring between the atomized Fe—Cr—Y powder particles and the reactive gas. By using a reactive atomization gas the surface oxide film formed around each powder particle instantaneously as the molten metal exited the pour tube and was impinged by the atomization gas. By reducing the oxygen concentration within the atomization gas the oxidation reaction was better controlled to prevent any premature nozzle tip freezing, and ensured complete atomization run capability. The entire alloy charge was poured and atomized into powder with a run time of 34.0 seconds.

The atomized powder particle yield was screened to select a size class from 20 to 53 microns, which represented about 43.5% of the collected powder, and 500 g of this powder was subjected to testing and characterization. Also, the powder yield was screened to select a size class below 20 microns, which represented about 12.6% of the collected powder, and 250 g of this powder was provided for testing of consolidation characteristics. The remainder of the powder that was collected during the run was retained for future characterization experiments. Oxygen analysis of the powder showed the average (Of 3 measurements) oxygen content to be 0.397 wt. % and was analyzed using a LECO inert gas fusion apparatus, capable of nitrogen and oxygen determination.

SEM examination of the as-atomized particles was used to characterize the as-solidified microstructure and to evaluate the surface oxide coating of the powder particles. The as-atomized particles were blended with 75 vol. %, 20-53 μm copper powder, and cold isostatically pressed (CIP) to 414 MPa (60 ksi), in order to hold in place multiple Fe—Cr—Y particles for surface oxide evaluation. The blended and CIP consolidated powder was cross-sectioned, polished, and analyzed using an SEM with EDS line-scan capabilities.

The resulting chemical evaluation (EDS line-scan) of the Fe—Cr—Y as-atomized surface revealed (not shown) an increased presence of chromium and oxygen at the surface of the particles and a decreased presence of iron. In addition, the surface oxide stoichiometric composition was defined using quantitative wave dispersive spectroscopy (WDS) (not shown), and was found to be chromium oxide ($Cr_2O_3$).

Figure 2:
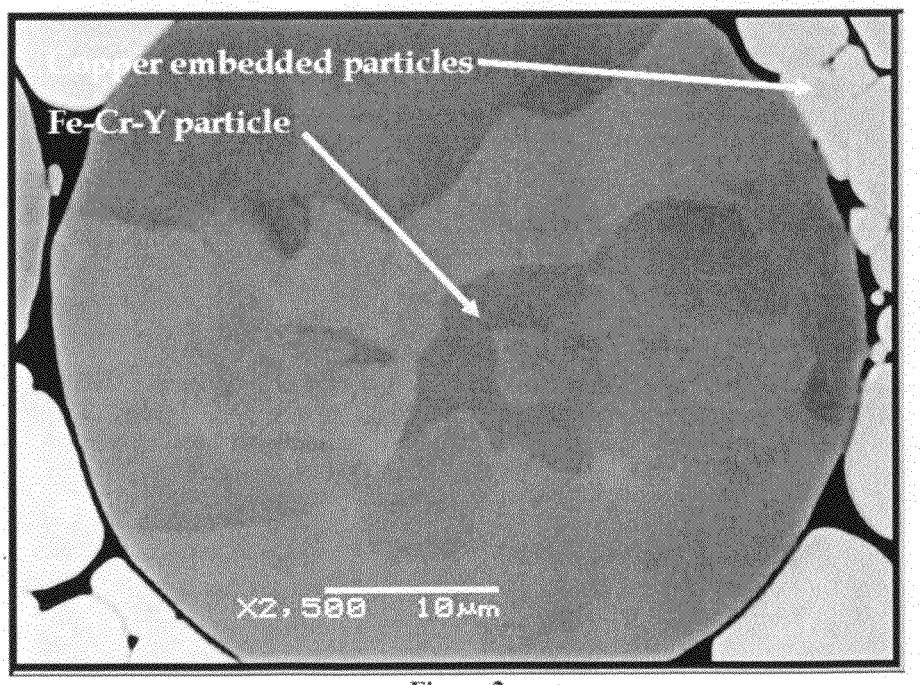
FIG. 2 is a SEM of an as-atomized Fe—Cr—Y particle embedded in copper powder of Example 3.

Additional SEM evaluation of the Cu embedded as-atomized powders revealed that the cross-section microstructure of a single powder particle was single phase (but multi-grained, shown by varying grey contrast) and showed no apparent compositional segregation, e.g., $Fe_{17}Y_2$ phase, or Y-enriched oxide dispersoid formation (see FIG. 2).

Figure 3:
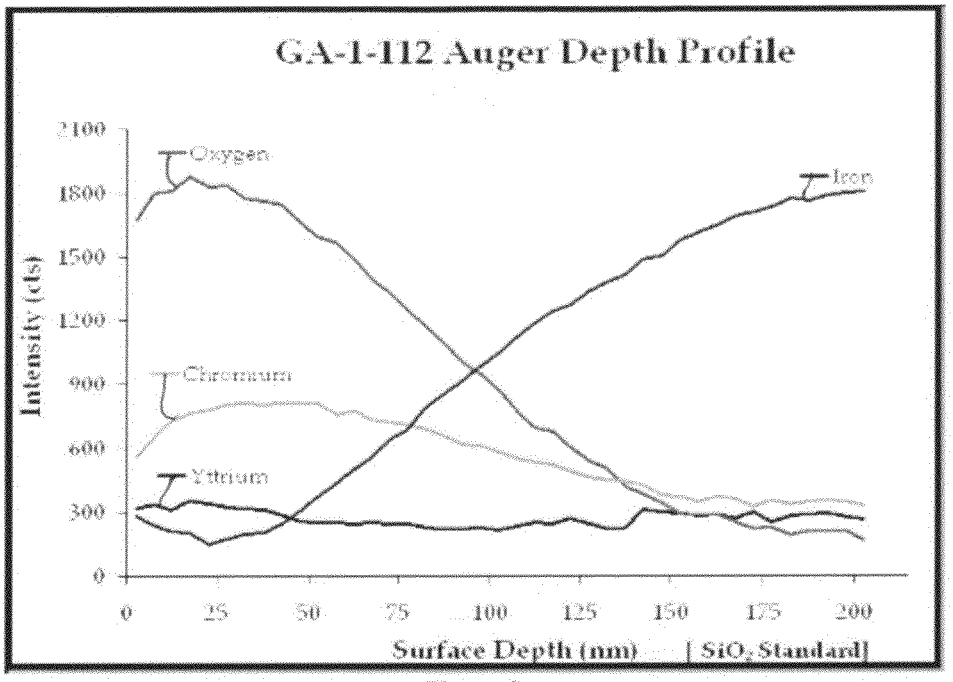
FIG. 3 presents Auger electron spectroscopy results for depth profile of oxygen, iron, chromium, and yttrium of an as-atomized Fe—Cr—Y particle of Example 3.

The Fe—Cr—Y particles were examined using Auger electron spectroscopy (AES) with depth profiling capabilities, in order to characterize the surface oxide composition and the surface oxide thickness, as shown in FIG. 3. The average surface oxide ($Cr_2O_3$) thickness, based on a $SiO_2$ sputtering rate constant, was calculated to be about 100 nm. Apparently, the surface oxide formation is dependant on the kinetics of the in-situ oxide formation from the liquid alloy droplets and not the relative thermodynamic stability of the oxide. For this reason the surface oxide forms as chromium oxide and, because it is less stable than the Y-enriched dispersoids, it is susceptible to dissociation during elevated temperature consolidation and heat treatment.

Figure 4:
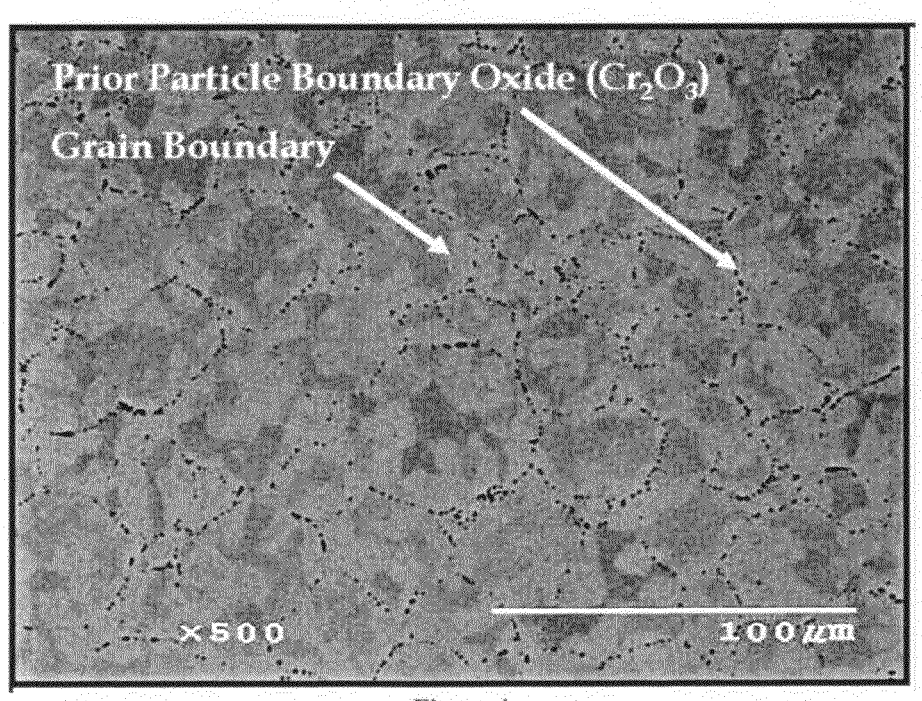
FIG. 4 is a SEM of a consolidated microstructure of Example 3.

SEM examination has shown that the fully consolidated microstructure, using hot isostatic pressing (HIP) at 1300° C. and 303 MPa for 4 hours in a 316L stainless steel can, has partially dissolved the chromium oxide phase ($Cr_2O_3$) on the prior particle boundaries (PPB), which allows for a large amount of metal-metal bonding to develop across PPB. This strengthens the consolidated polycrystalline microstructure (geometric variation in grey contrast) and ensures maximum densification, as shown in FIG. 4. This consolidated microstructure is typical when the ratio of yttrium-to-oxygen is in a non-ideal balance, with not enough yttrium to react with all of the PPB oxide phase, shown in dark contrast along the PPB traces.

Figure 5:
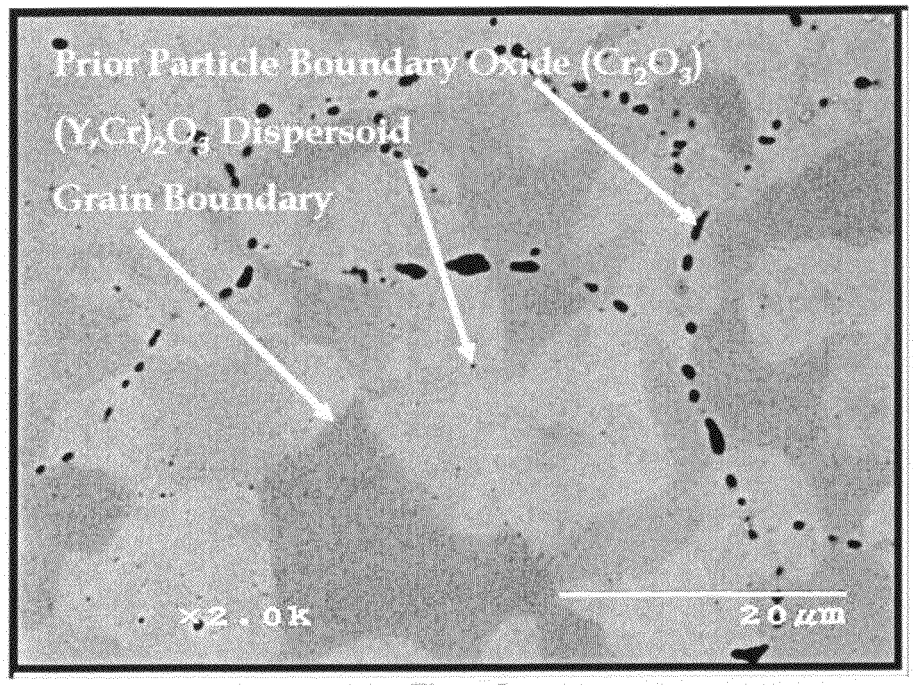
FIG. 5 is another SEM of a consolidated microstructure of Example 3.

Further SEM examination revealed that when the PPB oxide phase ($Cr_2O_3$) dissociates, during the elevated temperature consolidation, the formation of Y-enriched oxide dispersoids form along grain boundaries and within grains, as shown in FIG. 5. This dispersoid phase was identified as $(Y,Cr)_2O_3$ using TEM analysis with EDS capabilities. The SEM analysis of the as-atomized microstructure also showed that the $(Y,Cr)_2O_3$ dispersoids have a diameter less than 0.5 μm (not shown). Further TEM analysis is needed to fully characterize the average diameter of these oxide dispersoids.

Experimental results compiled from analyzing as-atomized microstructures compared with as-consolidated microstructures show a clear ability to transform a less thermodynamically stable surface oxide ($Cr_2O_3$) into a more thermodynamically stable oxide dispersoid phase, typically $(Y,Cr)_2O_3$, during elevated temperature consolidation of as-atomized precursor powder. Due to the well distributed locations of the precipitated oxide dispersoids, it was shown that oxygen, released from the PPB oxides during phase dissociation at elevated temperature, is diffusing into the iron alloy matrix and reacting with soluble yttrium atoms to form a stable oxide dispersoid precipitate, according to the method of this invention.

Example 4

GA-1-118

Example 4 sets forth conditions for GARS processing of an iron alloy having Cr as a corrosion/oxidation resistance-imparting solid solution alloying element, Y as a dispersoid-forming element, and Ti as an oxygen diffusion assisting element and a dispersoid phase stabilizing element shown in FIG. 10. The nominal composition of the alloy, in weight %, was 15.0% Cr, 0.51% Y, 0.54% Ti and balance Fe. The Cr alloying element was present in an amount effective to impart intrinsic corrosion and oxidation resistance to the particle alloy matrix, which corresponds to the Cr-rich side of the specifications of a Type 405 ferritic stainless steel at least with respect to Fe and Cr concentrations. The Y is provided in an amount to enhance reaction in the surface region and elsewhere in the particle matrix with dissolved O (reactive species) and with any oxide compounds to form refractory dispersoids in the particle alloy matrix during atomization and/or later during solid state high temperature processing. The Ti alloying element was added in an amount that was necessary to assist in oxygen transport during the dissociation of the prior particle boundary oxide phase (PPB). The Ti also was intended to help to stabilize the nano-metric size of the eventual Y—Ti—O containing dispersoid phase.

The melting furnace was charged with 4000 g, comprising 3453.1 g of Fe (Tophet, high purity grade), 600 g of Cr (Tosoh, high purity grade), 26.32 g of an Fe—Y chill cast button (Fe-76Y, wt. %) using Y of 99.5% purity, and 21.6 g of Ti (99.95% high purity grade). The charge was melted in the induction melting furnace in a high purity, coarse grain zirconia (MgO-stabilized) crucible, obtained from Zircoa. A pour tube made of plasma arc spray deposited zirconia ($Y_2O_3$ stabilized) and a stopper rod made of hard fired alumina, obtained from Coors Ceramics, were used. The charge was melted in the induction furnace after the melting chamber and the drop tube were evacuated to $7.7\times10^{-5}$ atmosphere and then pressurized with argon to 1.1 atmosphere. The melt was heated to a temperature of 1700 C (providing about 160 C superheat above the alloy liquidus temperature). After a hold period of 2 minutes to stabilize the molten alloy temperature, the melt was fed via the pour tube to the atomizing nozzle by gravity flow upon raising the alumina stopper rod. The atomizing nozzle was of the type described in U.S. Pat. No. 5,125,574, the teachings of which are incorporated herein by reference with respect to nozzle construction.

The atomizing gas comprised a mixture of argon and oxygen in a ratio of 99.5:0.5 (i.e., 99.5 vol. % Ar and 0.5 vol. % $O_2$) shown in FIG. 10 and was supplied as a factory made mixture. The argon/oxygen gas mixture was supplied at 6.9 MPa (1000 psig), measured at the respective gas supply regulator, to the atomizing nozzle. The flow rate of the atomizing gas mixture to the atomizing nozzle was about 10.3 $m^3$/min.

This atomization experiment was performed to test the ability to manipulate the in situ surface oxidation reaction occurring between the atomized Fe—Cr—Y—Ti powder particles and the reactive gas. By using a reactive atomization gas the surface oxide film formed around each powder particle instantaneously as the molten metal exited the pour tube and was impinged by the atomization gas. By reducing the oxygen concentration within the atomization gas the oxidation reaction was better controlled to prevent any premature nozzle tip freezing, and ensured complete atomization run capability. The entire alloy charge was poured and atomized into powder with a run time of 25.5 seconds. The run time was similar to that of Example 3, because of the same processing reasons.

The atomized powder particle yield was screened to select a size class from 20 to 53 microns, which represented about 38.1% of the collected powder, and 500 g of this powder was subjected to testing and characterization. Also, the powder yield was screened to select a size class below 20 microns, which represented about 11.8% of the collected powder, and 250 g of this powder was provided for testing of consolidation characteristics. The remainder of the powder that was collected during the run was retained for future characterization experiments. Oxygen analysis of the powder showed the average (of 3 measurements) oxygen content to be 0.382 wt. % and was analyzed using a LECO inert gas fusion apparatus, capable of nitrogen and oxygen determination.

SEM examination of the as-atomized particles was used to characterize the as-solidified microstructure and to evaluate the surface oxide coating of the powder particles. The as-atomized particles were blended with 75 vol. %, 20-53 μm copper powder, and cold isostatically pressed (CIP) to 414 MPa (60 ksi), in order to hold in place multiple Fe—Cr—Y—

Ti particles for surface oxide evaluation. The blended and CIP consolidated powder was cross-sectioned and analyzed using an SEM with EDS line-scan capabilities. The resulting chemical evaluation of the Fe—Cr—Y—Ti as-atomized surface revealed an increased presence of titanium and a decreased presence of iron (not shown). The surface oxide stoichiometric composition was determined using quantitative wave dispersive spectroscopy (WDS) (not shown), and was found to be titanium oxide (TiO).

Elemental concentration mapping also was done using WDS analysis. The WDS concentration maps showed a high surface concentration of both titanium and oxygen. The titanium map revealed a high surface concentration in conjunction with a denuded zone below the surface of approximately 2 μm. The denuded zone is thought to be related to the diffusion kinetics of titanium within the molten iron-based alloy before solidification. Also, the titanium map showed a non-uniform solidification structure, where titanium appears to segregate to possible cellular solidification boundary regions. The oxygen map showed a high surface concentration with essentially no internal penetration. The yttrium map illustrated a slight increase in concentration just below the particle surface. Yttrium also appeared to segregate to possible cellular boundary regions, much like titanium. The chromium map showed a decreased concentration at the surface of the particle and a relatively uniform concentration within the interior of the particle.

Figure 6:
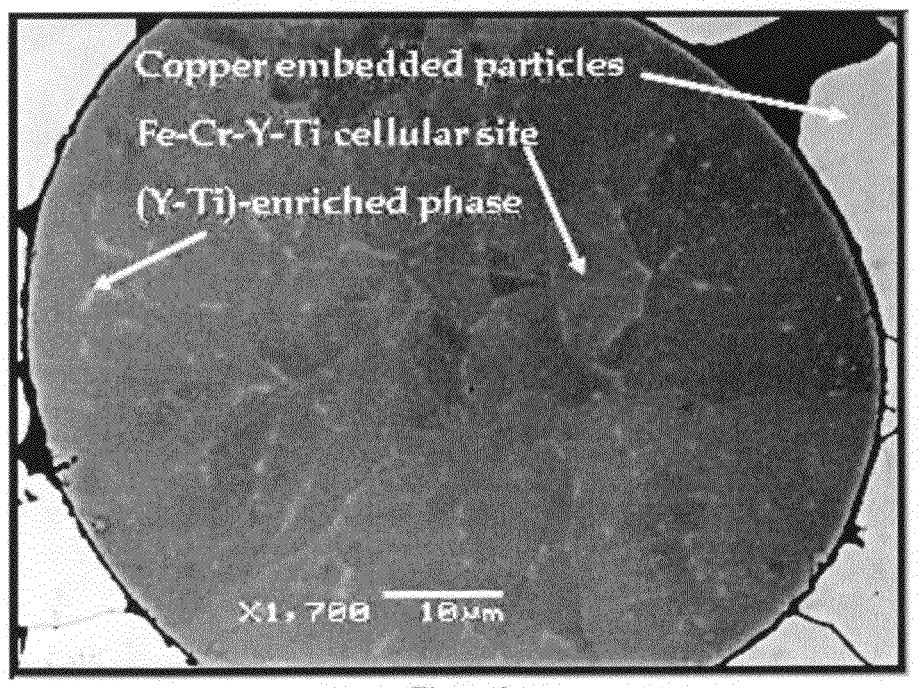
FIG. 6 is a SEM of an as-atomized Fe—Cr—Y particle embedded in copper powder of Example 4.

Additional SEM evaluation on the copper embedded Fe—Cr—Y—Ti particles revealed that the as-atomized particle microstructure contained two distinct phases, shown in FIG. 6 as a dark grey matrix phase and a "networked" light contrast phase. The matrix phase was determined to be alpha-iron, and recorded no concentrations of yttrium or titanium when analyzed using point mode EDS (not shown). The light phase demonstrated high concentrations of yttrium and titanium (consistent with the WDS results) when analyzed using point mode EDS (not shown), but exact phase determination has yet to be established. It was apparent that during solidification yttrium and titanium segregated to cellular boundary regions. Although elemental segregation occurred during solidification no apparent formation of oxide dispersoids were detected with SEM analysis, but the higher spatial resolution of TEM is needed to verify this observation.

Figure 7:
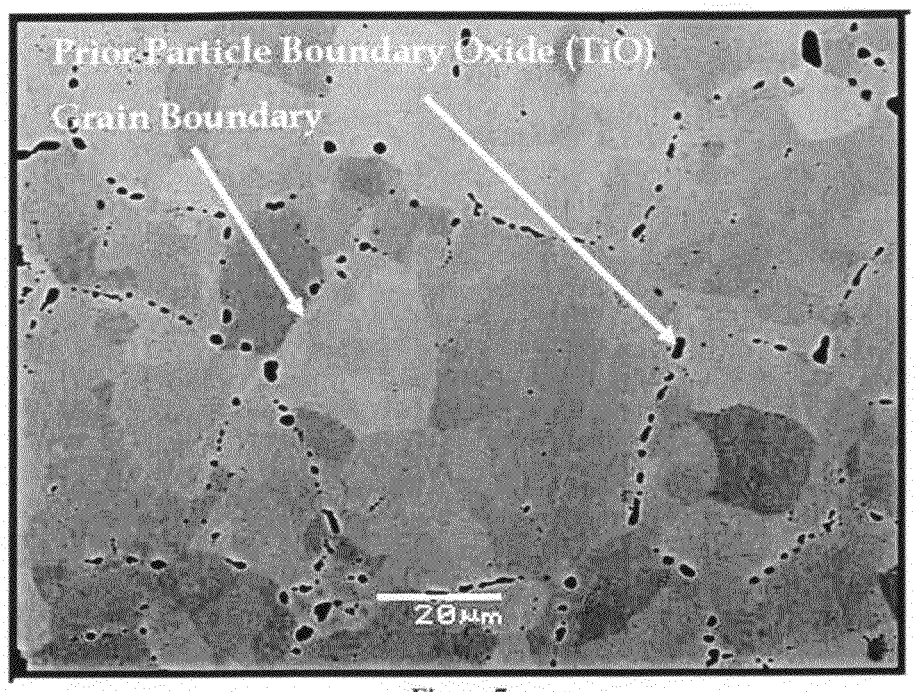
FIG. 7 is a SEM of a consolidated microstructure of Example 4.

SEM examination has shown that the as-consolidated microstructure (HIP at 1300° C. and 303 MPa for 4 hours in a 316L stainless steel can) has partially dissolved the titanium oxide phase (TiO) on the prior particle boundaries (PPB), which allows for a large amount of metal-metal bonding to transpire across PPB. This strengthens the consolidated microstructure and ensures maximum density, as shown in FIG. 7. This cross-section microstructure is typical when the ratio of yttrium-to-oxygen is non-ideal with not enough yttrium to react with all of the PPB oxide phase.

Figure 8:
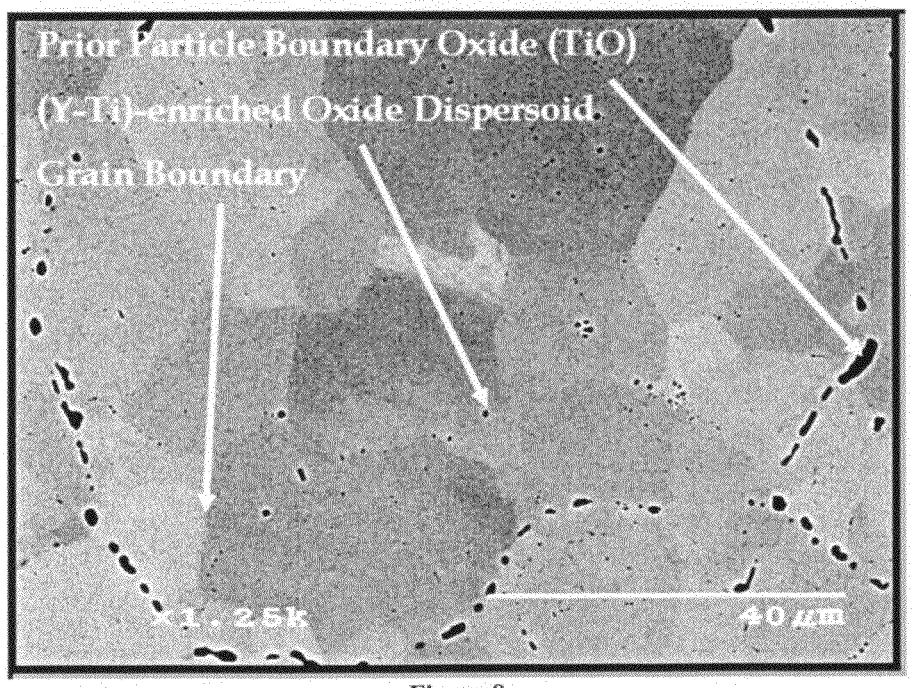
FIG. 8 is another SEM of a consolidated microstructure of Example 4.
Figure 9:
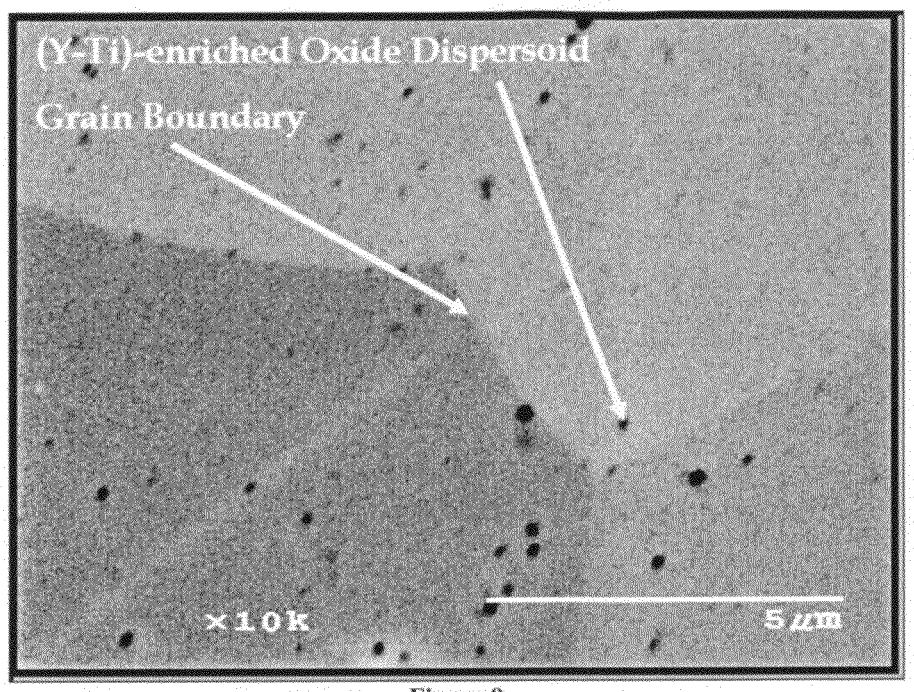
FIG. 9 is another SEM with point EDS capabilities of a consolidated microstructure of Example 4.

Further SEM examination revealed that when the PPB oxide phase (TiO) dissociates, during the elevated temperature consolidation, the formation of Y-enriched dispersoid oxides form along grain boundaries and within grains, as shown in FIG. 8. Further SEM analysis with point EDS capabilities, showed the oxide dispersoids to be yttrium and titanium enriched (not shown). Detailed SEM characterization (FIG. 9) also showed that the (Y—Ti)-enriched oxide dispersoids had a diameter less than 0.5 μm. Further TEM analysis is needed to fully characterize the average diameter of these oxide dispersoids. TEM also will be needed to accurately define the dispersoid phase and to fully characterize the role of the Cr in the microstructure development.

Experimental results compiled from analyzing as-atomized microstructures compared with as-consolidated microstructures show a clear ability to transform a less thermodynamically stable surface oxide (TiO) into a more thermodynamically stable oxide dispersoid ((Y—Ti)-enriched) during elevated temperature consolidation of as-atomized precursor powder. The Cr alloy content does not seem to have a significant role in the exchange reaction in this case, but probably enhances the diffusion rate of oxygen in the matrix during consolidation and heat treatment by promoting a phase transformation to a FCC (i.e. gamma-iron) phase at high temperature, as evidenced by high temperature X-ray diffraction results (not shown).

The formation of a (Y—Ti)-enriched phase along as-solidified cellular sites is believed to increase transformation rate kinetics between the dissolving PPB oxide and the yttrium metal (actual rate kinetics of transformation reaction has yet to be determined). This as-solidified (Y—Ti)-enriched phase acts as a pathway for oxygen to diffuse internally, and permits the precipitation of (Y—Ti)-enriched oxide dispersoids during elevated temperature consolidation. After consolidation the (Y—Ti)-enriched phase no longer can be observed.

The present invention is advantageous to provide internally dispersion hardened GARS alloy particles, which provide the ability for further strengthening during consolidation and/or heat treating and which may be able to duplicate the strengthening and high temperature stability of previous mechanically alloyed Ni-base powders at a fraction of the material and processing cost. The atomized alloy particles pursuant to the invention have been consoldiated by hot isostatic pressing (HIP) to full density and press/sinter consolidation (with residual porosity) and any be direct (hot) extruded into perform shapes for forging into final parts or metal injection molded directly into net shapes. The atomized alloy particles also can be advantageous for direct spray deposition of oxide dispersion strengthened billet performs, which can be forged.

Moreover, it is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages. The form hereinbefore described being merely a preferred or exemplary embodiment thereof.

While the invention has been described in terms of specific embodiments thereof, it is not intended to be limited thereto but rather only to the extent set forth hereafter in the following claims.

We claim:

1. As-atomized, prealloyed particles, each comprising a matrix metal comprising iron, an environmental resistance-imparting alloying element, a dispersoid-forming element to form dispersoid particles, and a reactive species present in solid solution and/or as a compound in an amount sufficient to complete a reaction with said dispersoid-forming element to form dispersoid particles but not exceeding about 10,000 ppm by weight wherein the atomized particles each include a metastable surface compound that is formed by reaction of the reactive species with the alloying element and that is relatively less thermodynamically stable than the dispersoid particles.

2. The particles of claim 1 wherein the reactive species is present in an amount sufficient to complete the reaction with the dispersoid-forming element but not exceeding about 4000 ppm by weight.

3. The particles of claim 1 wherein the reactive species is present in an amount sufficient to complete the reaction with the dispersoid-forming element but not exceeding about 2000 ppm by weight.

4. The particles of claim 1 wherein the reactive species comprises oxygen in solid solution and/or as a compound formed by reaction with an atomizing gas mixture including said reactive species and a carrier gas.

5. The particles of claim 1 having at least a near surface region that contains the dispersoids and interior region that contains the dispersoid-forming element dissolved in solid solution and/or as a compound.

6. The particles of claim 1 wherein the environmental resistance-imparting alloying element is selected from the group consisting of Cr, Mo, W, V, Nb, Ta, Ti, Zr, Ni, Si and B.

7. The particles of claim 1 wherein the dispersoid-forming element is selected from the group consisting of Sc, Y, and a Lanthanide series element having an atomic number from 57 to 71 to form stable strengthening dispersoid particles with said reactive species.

8. The particles of claim 1 wherein a dispersoid-enriching element is provided and is selected from the group consisting of Ti, Ce, Sr, Zr, Mg, Hf, Be, V, Nb, Ta, Cr, Mo, W, and Si.

9. A thermally sprayed deposit comprising as-atomized, prealloyed particles, each comprising a matrix metal comprising iron, an environmental resistance-imparting alloying element, a dispersoid-forming element to form dispersoid particles, and a reactive species present in solid solution and/or as a compound in an amount sufficient to complete a reaction with said dispersoid-forming element to form dispersoid particles but not exceeding about 10,000 ppm by weight, wherein the atomized particles each include a metastable surface compound that is formed by reaction of the reactive species with the alloying element and that is relatively less thermodynamically stable than the dispersoid particles, wherein the particles are deposited as overlying splats that solidify on a mandrel.

10. A consolidated body comprising the deposit of claim 9 that is hot extruded or hot forged under sufficient time, temperature, pressure and/or deformation conditions, or combinations thereof, to achieve densification and intersplat bonding as well as form further dispersoid particles by dissolution of said metastable surface compound providing a source of the reactive species during hot extruding and/or hot forging for reaction with the dispersoid-forming element for further strengthening.

11. A sintered body comprising the deposit of claim 9 wherein the splats are sintered together at sufficient time and temperature to achieve improved intersplat bonding as well as form further dispersoid particles by dissolution of said metastable surface compound providing a source of the reactive species during sintering for reaction with the dispersoid-forming element for further strengthening.

12. A consolidated body comprising the particles of claim 1 that are vacuum hot pressed, hot isostatic pressed, hot extruded, or direct hot powder forged under sufficient time, temperature, pressure and/or deformation conditions, or combinations thereof, to achieve densification and interparticle bonding as well as form further dispersoid particles by dissolution of said metastable surface compound providing a source of the reactive species for reaction with the dispersoid-forming element for further strengthening.

13. A sintered body comprising the as-atomized, prealloyed particles of claim 1 which are sintered together at sufficient time and temperature to achieve interparticle bonding as well as form further dispersoid particles by dissolution of said metastable surface compound providing a source of the reactive species during sintering for reaction with the dispersoid-forming element for further strengthening.

14. Atomized alloy particles, each comprising a matrix metal comprising iron, an environmental resistance-imparting alloying element, a dispersoid-forming element to form dispersoid particles, and a reactive species present in solid solution and/or as a compound in an amount sufficient to complete a reaction with said dispersoid-forming element to form dispersoid particles but not exceeding about 4,000 ppm by weight.

15. Atomized alloy particles, each comprising a matrix metal comprising iron, an environmental resistance-imparting alloying element, a dispersoid-forming element to form dispersoid particles, and a reactive species present in solid solution and/or as a compound in an amount sufficient to complete a reaction with said dispersoid-forming element to form dispersoid particles but not exceeding about 2,000 ppm by weight.

* * * * *